United States Patent [19]

Hutchison

[11] Patent Number: 4,498,998

[45] Date of Patent: Feb. 12, 1985

[54] STABILIZATION OF HYDROCRACKED OILS AGAINST UV-LIGHT DEGRADATION WITH CERTAIN DIHYDROXY COMPONENTS

[75] Inventor: David A. Hutchison, Munster, Ind.

[73] Assignee: Atlantic Richfield Company, Philadelphia, Pa.

[21] Appl. No.: 375,522

[22] Filed: May 6, 1982

Related U.S. Application Data

[63] Continuation of Ser. No. 210,427, Nov. 25, 1980, abandoned.

[51] Int. Cl.[3] ..... C10M 1/20

[52] U.S. Cl. ..... 252/52 R; 252/404

[58] Field of Search ..... 252/52 R, 404

[56] References Cited

U.S. PATENT DOCUMENTS

| | | | |
|---|---|---|---|
| 2,031,930 | 2/1936 | Buc | 252/52 R |
| 2,116,220 | 5/1938 | Shoemaker | 252/52 R |
| 2,388,887 | 11/1945 | Weissberger et al. | 252/52 R X |
| 2,831,817 | 4/1958 | Ecke et al. | 252/52 R X |
| 2,927,932 | 3/1960 | Preston | 252/52 R X |
| 3,043,672 | 7/1962 | Ecke et al. | 252/52 R X |
| 3,424,821 | 1/1969 | Hunter | 252/52 R |

FOREIGN PATENT DOCUMENTS

| | | | |
|---|---|---|---|
| 2545786 | 12/1974 | Fed. Rep. of Germany | 252/52 R |

*Primary Examiner*—Andrew Metz

*Attorney, Agent, or Firm*—Frank J. Uxa

[57] ABSTRACT

Hydrocracked lubricating oils are effectively stabilized against deterioration caused by light by the inclusion of at least one of certain dihydroxy components. Such component, e.g., 3,5-di-tert-butyl catechol and 4,6-di-tert-butyl resorcinol, provide outstanding inhibition to sunlight deterioration.

13 Claims, No Drawings

STABILIZATION OF HYDROCRACKED OILS AGAINST UV-LIGHT DEGRADATION WITH CERTAIN DIHYDROXY COMPONENTS

This is a continuation of application Ser. No. 210,427, filed Nov. 25, 1980 and now abandoned.

The invention relates to a method of stabilizing a hydrocracked oil. More particularly, it relates to stabilizing such oils against light deterioration by adding thereto at least one of certain dihydroxycomponents.

It is known that oils in general will degrade slowly in the presence of light. Oils such as the economically valuable hydrocracked lubricating oils used in his invention, degrade in light, especially in the presence of air. Since the hydrocracked oils are valuable, there has been considerable effort to find ways to prevent their breakdown due to light.

U.S. Pat. No. 4,036,770 teaches a method for stabilizing hydrocracked oils which involves adding nitro-containing aromatic amine components. Such components are relatively expensive and therefore may add significantly to the cost of hydrocracked oils. Also, such components may impart a less than desirable color and/or odor to the final product.

U.S. Pat. No. 4,101,430 teaches that oxidative degradation of lubricant compositions containing certain organo sulfur-containing nickel complexes is inhibited.

U.S. Pat. Nos. 2,785,188 and 3,156,543 teach the use of 3,3',5,5'-tetra alkyl-4,4'dihydroxy diphenyls as oxidation stabilizers for hydrocarbon fuels, such as gasoline. U.S. Pat. No. 3,156,543 discloses that 4,4'-bis(2-isopropyl-6-tert-butylphenol) is a light yellow crystalline substance and is highly soluble in gasoline, diesel fuel and lubricating oil. However, neither of these references teach either inhibition of deterioration from light exposure or hydrocracked lubricating oils.

One object of the present invention is to provide an improved method for stabilizing hydrocracked lubricating oils against the deteriorating effects of light.

Another object of the invention is to provide an improved composition of matter involving a hydrocracked lubricating oil which has improved inhibition against deterioration by light. Other objects and advantages of the present invention will become apparent hereinafter.

An improved hydrocracked oil composition has now been discovered. This composition comprises a major amount, preferably at least about 70%, by weight of a hydrocracked lubricating oil and a minor amount by weight of at least one added dihydroxy component having a structure:

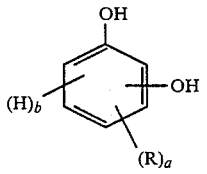

wherein each R is independently selected from the group consisting of substantially monovalent hydrocarbonaceous radicals containing 1 to about 24, preferably 1 to about 14 and more preferably 1 to about 10, carbon atoms; and a and b are integers such that a is equal to at least 2, preferably equal to 2, and the sum of a plus b equals 4.

It is preferred that the hydrocarbonaceous radicals be substantially saturated aliphatic radicals. Also, it is preferred that each of the R groups include at least one tertiary carbon atom. More preferably, each of the R groups has the same structure and, still more preferably, each of the R groups is a tertiary butyl group.

In a preferred embodiment, the added dihydroxydiphenyl component comprises about 0.005% to about 2.0% more preferably, about 0.01% to about 1.0%, by weight of the total composition.

The term "hydrocracked lubricating oil" means an oil, preferably a mineral oil, of lubricating viscosity which is derived from a lubricating oil produced by contacting a hydrocarbon feedstock with hydrogen, preferably in the presence of catalyst effective to promote hydrocracking, at hydrocarbon hydrocracking conditions to produce an oil of lubricating viscosity having an increased viscosity index relative to the viscosity index of the hydrocarbon feedstock. In addition, the hydrocracked lubricating oil may be subjected to additional processing, e.g., further contacting with hydrogen- again preferably in the presence of an effective catalyst-, other purifying procedures and the like, to further improve the quality, e.g., color, of the hydrocracked lubricating oil. For example, hydrocracked lubricating oils useful in the present invention may be obtained by the processes disclosed in U.S Pat. No. 3,642,610, the specification of which is hereby incorporated by reference herein.

Typical examples of the substantially monovalent hydrocarbonaceous radicals from which R may be selected includes alkyl, such as methyl, ethyl, propyl, butyl, pentyl, hexyl (including cyclohexyl), octyl, decyl, dodecyl, hexadecyl, stearyl and the like; alkenyl such as ethylenyl, propenyl, butenyl, oleyl, linoleyl and the like; aryl, such as phenyl, benzyl and the like; alkaryl such as methyl phenyl, ethyl phenyl, butyl phenyl, octyl phenyl, stearyl phenyl and the like; alkenaryl such as ethylenyl phenyl, octenyl phenyl, oleyl phenyl and the like; aralkyl such as phenyl ethyl, phenyl octyl, phenyl stearyl and the like; and aralkenyl such as phenyl ethylenyl, phenyl butenyl, phenyl octenyl, phenyl oleyl and the like. As noted above, it is preferred that such hydrocarbonaceous radicals be substantially saturated.

By "substantially hydrocarbonaceous" radical is meant those radicals which are composed mainly of hydrogen and carbon, and include such radicals which contain, in addition, minor amounts of substituents, such as chlorine, bromine, sulfur, nitrogen and the like, which do not substantially affect their hydrocarbon character. Preferably, such substantially hydrocarbonaceous radicals include only carbon and hydrogen atoms.

The presently useful dihydroxy component may be produced using procedures well known in the art.

The following examples illustrate more clearly the compositions and methods of the present invention. However, these illustrations are not to be interpreted as specific limitations on this invention.

EXAMPLES

These examples illustrate certain of the advantages of the present invention.

A commercially available hydrocracked oil of lubricating viscosity was selected for testing. This hydrocracked oil had the following properties.

| | |
|---|---|
| Initial Boiling Point, °F. | >600 |

-continued

| | |
|---|---|
| Viscosity, SUS at 100° F. | 156.0 |
| Viscosity Index | 106 |

This oil was derived using a well known lube oil hydrocracking process.

Varying amounts of 3,5-di-tert-butyl catechol were blended into samples of the hydrocracked oil. In order to determine the susceptibility of the oils and blends to light deterioration, 10 gram samples were placed in 250 ml. beakers and exposed to two (2) 275 watt U.V. sunlamps at seven (7) inches on a rotating table for a period of fifteen (15) hours. After the fifteen (15) hour exposure period, each of the samples was processed to determine the amount of solids (sludge) formation. The following results were obtained:

| Hydrocracked Oil | 3,5-di-tert-butyl catechol weight percent | Solids After Exposure mg./gm. oil |
|---|---|---|
| Sample 1 | 0.00 | 1.23 |
| 2 | 0.01 | 1.01 |
| 3 | 0.025 | 0.94 |
| 4 | 0.05 | 0.77 |
| 5 | 0.10 | 0.55 |
| 6 | 0.15 | 0.36 |
| 7 | 0.20 | 0.30 |
| 8 | 0.40 | 0.16 |
| 9 | 0.70 | 0.08 |
| 10 | 1.00 | 0.07 |

A series of five additional compositions were blended using the hydrocracked oil noted above and 4,6-di-tert-butyl resorcinol. These five compositions were tested using the above described procedure and the following results were obtained:

| | 4,6 di-tert-butyl resorcinol weight percent | Solids After Exposure mg./gm. oil |
|---|---|---|
| 10 | 0.20 | 0.43 |
| 11 | 0.40 | 0.11 |
| 12 | 0.60 | 0.02 |
| 13 | 0.80 | 0.00 |
| 14 | 1.00 | 0.01 |

These results indicate that hydrocracked lubricating oil alone is susceptible to deterioration by sunlight.

The dihydroxy components, as set forth in the present invention, are shown to provide substantial inhibition of deterioration of hydrocracked oil by sunlight. In addition, such dihydroxy components impart little or no distasteful odor to the hydrocracked oil compositions. This is in significant contrast to (and is a substantial benefit relative to) compositions which include various of the nitrogen-containing materials which have been suggested by the prior art for inhibiting light deterioration of hydrocracked oils.

While this invention has been described with respect to various specific examples and embodiments, it is to be understood that the invention is not limited thereto and that it can be variously practiced within the scope of the following claims:

The embodiments of the invention in which an exclusive property or privilege is claimed are defined as follows:

1. A composition of matter comprising a major amount by weight of hydrocracked lubricating oil having susceptibility to deterioration by sunlight and a minor amount by weight, sufficient to inhibit said composition from deterioration caused by sunlight, of at least one added dihydroxy component having a structure

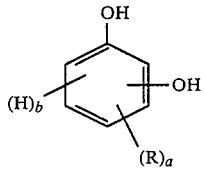

wherein each R is independently selected from the group consisting of tertiary alkyl radicals containing up to about 10 carbon atoms, and a and b are integers such that a is equal to at least 2 and the sum of a plus b equals 4.

2. The composition of claim 1 wherein said hydrocracked lubricating oil comprises at least about 70% by weight of said composition.

3. The composition of claim 2 wherein said added dihydroxy component comprises about 0.005% to about 2.0% by weight of said composition.

4. The composition of claim 2 wherein said dihydroxy component comprises about 0.01% to about 1.0% by weight of said composition.

5. The composition of claim 2 wherein a is equal to 2 and said dihydroxy component comprises about 0.01% to about 1.0% by weight of said composition.

6. The composition of claim 2 wherein each of said R's has the same structure.

7. The composition of claim 6 wherein each of the R's is tertiary butyl.

8. A method of inhibiting a hydrocracked lubricating oil from deterioration caused by sunlight comprising combining with said oil having susceptibility to deterioration by sunlight an inhibiting amount of at least one dihydroxy component having a structure

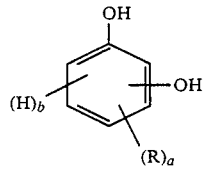

wherein each R is independently selected from the group consisting of tertiary alkyl radicals containing up to about 10 carbon atoms, and a and b are integers such that a is equal to at least 2 and the sum of a plus b equals 4.

9. The method of claim 8 wherein said dihydroxy component comprises about 0.005% to about 2.0% by weight of said composition.

10. The method of claim 8 wherein said dihydroxy component is present in an amount equal to about 0.01% to about 1.0% by weight of said composition.

11. The method of claim 8 wherein a is equal to 2 and said dihydroxy component comprises about 0.01% to about 1.0% by weight of said composition.

12. The method of claim 8 wherein each of said R's has the same structure.

13. The method of claim 11 wherein each of said R's is a tertiary butyl radical.

* * * * *